United States Patent [19]

Weiner et al.

[11] Patent Number: 4,674,596

[45] Date of Patent: Jun. 23, 1987

[54] SAFETY RIGGING SYSTEM FOR INFLATABLE ROOF STRUCTURES

[76] Inventors: Robert I. Weiner, 305 Chesapeake Ave., Towson, Md. 21502; Robert Magladry, 1125B Charles View Way, Towson, Md. 21204

[21] Appl. No.: 624,759

[22] Filed: Jun. 26, 1984

[51] Int. Cl.[4] ..... E04G 3/12

[52] U.S. Cl. ..... 182/3; 52/2

[58] Field of Search ..... 182/3, 4, 10, 40, 12, 182/45; 14/1, 18, 20, 22; 52/2

[56] References Cited

U.S. PATENT DOCUMENTS 3,137,487 6/1964 Lesser ..... 182/3

3,772,836 11/1973 Geiger ..... 52/83

3,860,089 1/1975 Huggett ..... 182/4

OTHER PUBLICATIONS

The History of the American Sailing Navy by H. Chapelle, 1974, pp. 138, 165 VM 23 C5N.

Bridges and Their Builders by Steinman et al., 1957, pp. 15–18, TG15S8.

*Primary Examiner*—John E. Murtagh

*Attorney, Agent, or Firm*—Peter L. Klempay

[57] ABSTRACT

In order to provide protection for workers moving on the exterior of an air-supported fabric roof structure, safety ropes extend across the roof and are connected at intervals to the roof, safety lines are adjustably attached between adjacent ones of the ropes and safety harnesses are adjustably attached to the safety lines.

12 Claims, 7 Drawing Figures

SAFETY RIGGING SYSTEM FOR INFLATABLE ROOF STRUCTURES

The present invention pertains to safety line riggings and, more particularly, to such rigging systems adapted for use on air supported roof structures.

BACKGROUND OF THE INVENTION

Roofs of air supported fabric panel construction, for example of the type disclosed in Geiger U.S. Pat. Nos. 3,772,836 and 3,835,599, have been constructed on large structures such as athletic stadiums and field houses as these roofs provide an unobstructed interior of large size. A problem which has been encountered with such roof constructions, however, is that of partial or total collapse of the roof as a result of excessive loading due to snow accumulation. In order to prevent such collapse, manual removal of snow from the roof structure has been resorted to. Typically, it is necessary for workers to climb upon the roof to manually shovel snow therefrom and, in view of the facts that the roof is snow and ice covered, slopes, and does not provide a rigid surface on which to move, the likelyhood of accidents is great. It is also possible that during the snow removal operations, the roof fabric may become torn, with the consequence that the worker is liable to fall through the resulting rent in the roof. As the height of these roof structures above the interior floor is great, such a fall is at least highly dangerous.

It is the primary object of the present invention to provide a safety rigging system for use by workers moving on the exterior of inflated roof structures and which allows their movement to any point on the roof surface and safe retreat therefrom in the event of a slip and fall.

It is also an object of the invention to provide a safety rigging system for inflatable roof structures which is effective to safely restrain a worker in the event a roof panel is rent or otherwise damaged.

It is a further object of the present invention to provide such a rigging system which is readily adaptable to existing roof structures or which may be incorporated into an inflatable roof structure at the time of construction.

It is another object of the invention to provide such a safety rigging system which is usable by workers moving on the roof without undue encumberence and which allows the hands to be free at all times for work or self-recovery from a slip or fall.

SUMMARY OF THE INVENTION

The above and other objects of the invention are achieved by the provision of a safety rigging system for an inflatable roof structure which includes a series of fixed safety lines, such as nylon rope, which are secured to the exterior of the roof structure in alignment with the cables forming the support structure for the roof panels; additional lines attached to adjacent ones of the series of safety lines to provide generally horizontal safety lines, the attachments being made by means of rope grabs to permit adjustment of the positioning of the horizontal safety lines and the horizontal safety lines including rope jams to accommodate the variations in the spacing of the fixed safety lines; and, for each worker, a parachute type safety harness and a safety lanyard for attaching the harness to one of the horizontal safety lines, preferrably by means of a rope grab.

For a more complete understanding of the invention and the objects and advantages thereof which will become apparent hereinafter, reference should be had to the accompanying drawings and the following detailed description wherein a preferred embodiment of the invention is illustrated and described.

DETAILED DESCRIPTION OF THE PREFERRED EMBODIMENT

Figure 1:
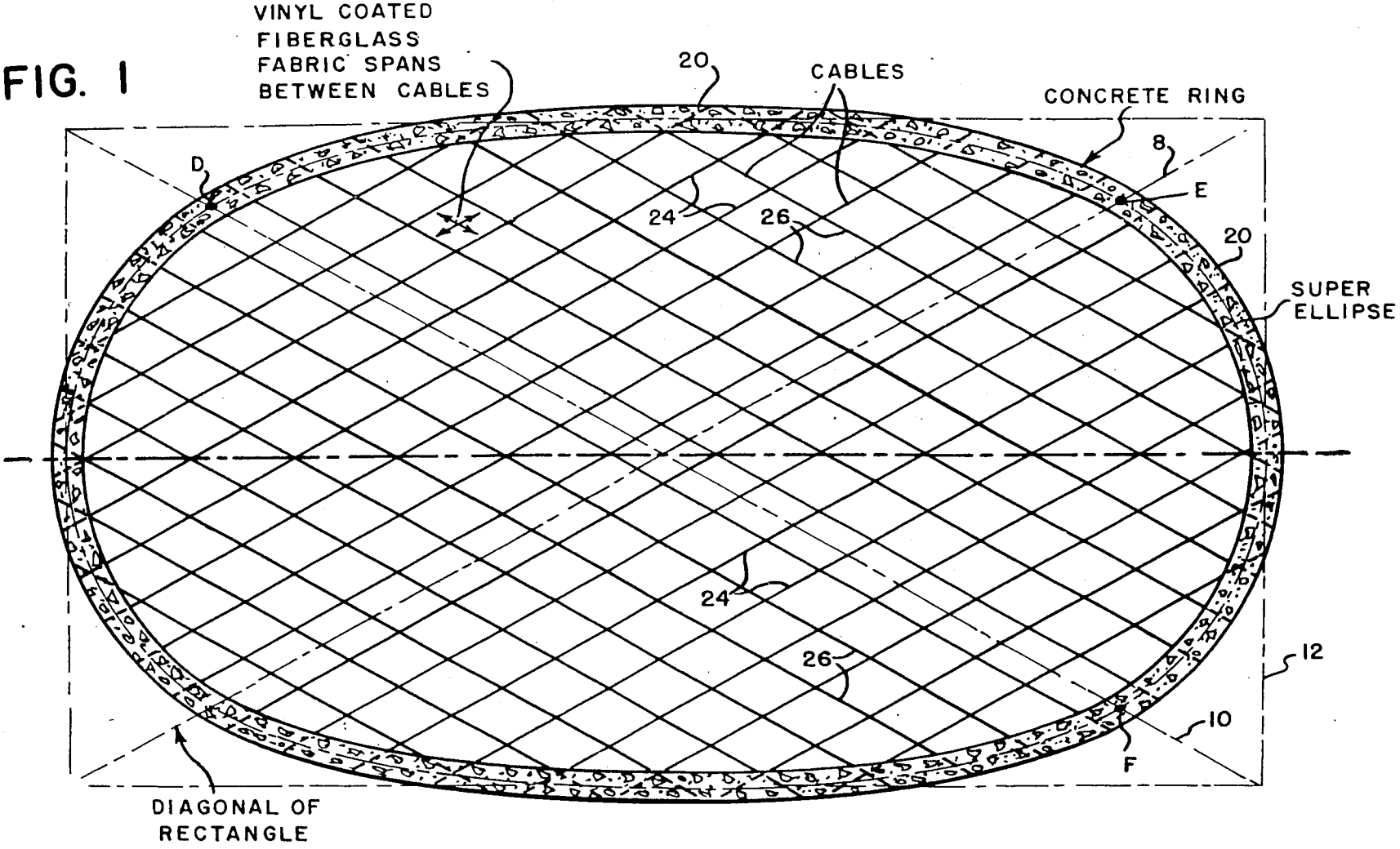
FIG. 1 is a plan diagramatic view of a cable supported fabric panel roof structure and corresponds directly to FIG. 4 of U.S. Pat. No. 3,835,599, Geiger.
Figure 2:
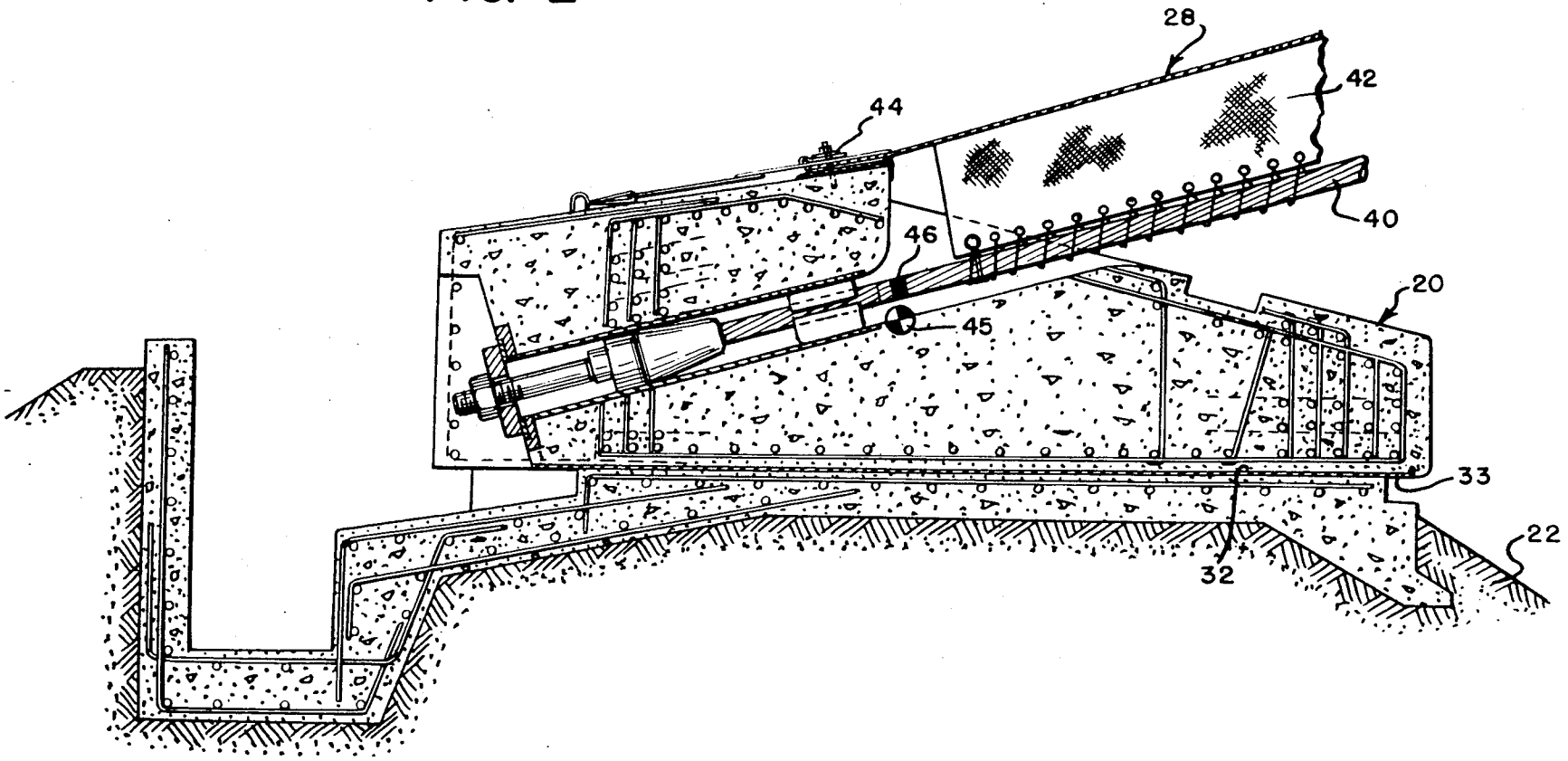
FIG. 2 a fragmentary sectional view of the roof structure of FIG. 1 and corresponds directly to FIG. 6 of U.S. Pat. No. 2,835,599, Geiger.

An air-supported fabric roof construction of the type with which the rigging system of the present invention may be employed is shown in FIGS. 1 and 2, these views being taken from U.S. Pat. No. 3,835,599, Geiger, and the reference numerals of that patent being used in the present description. The roof construction includes a concrete compression ring 20 surrounding the area covered by the roof and serving to anchor first and second sets of cables 24 and 26 which are interconnected at their points of intersection. Teflon or vinyl coated fiberglass panels 28 forming the roof membrane are attached to the cables by means of webs 42 and lashings and, at the perimeter of the roof, to the concrete ring 20 by means of a hold-down strip 44. The space within the confines of the roof is maintained at a pressure slightly above atmospheric so as to pre-tension the roof and form a domed structure. While the rigging system of the present invention will be described in conjunction with a roof construction of this type, it will be understood that the invention is not limited thereto and may be employed with other types of roof construction.

Figure 3:
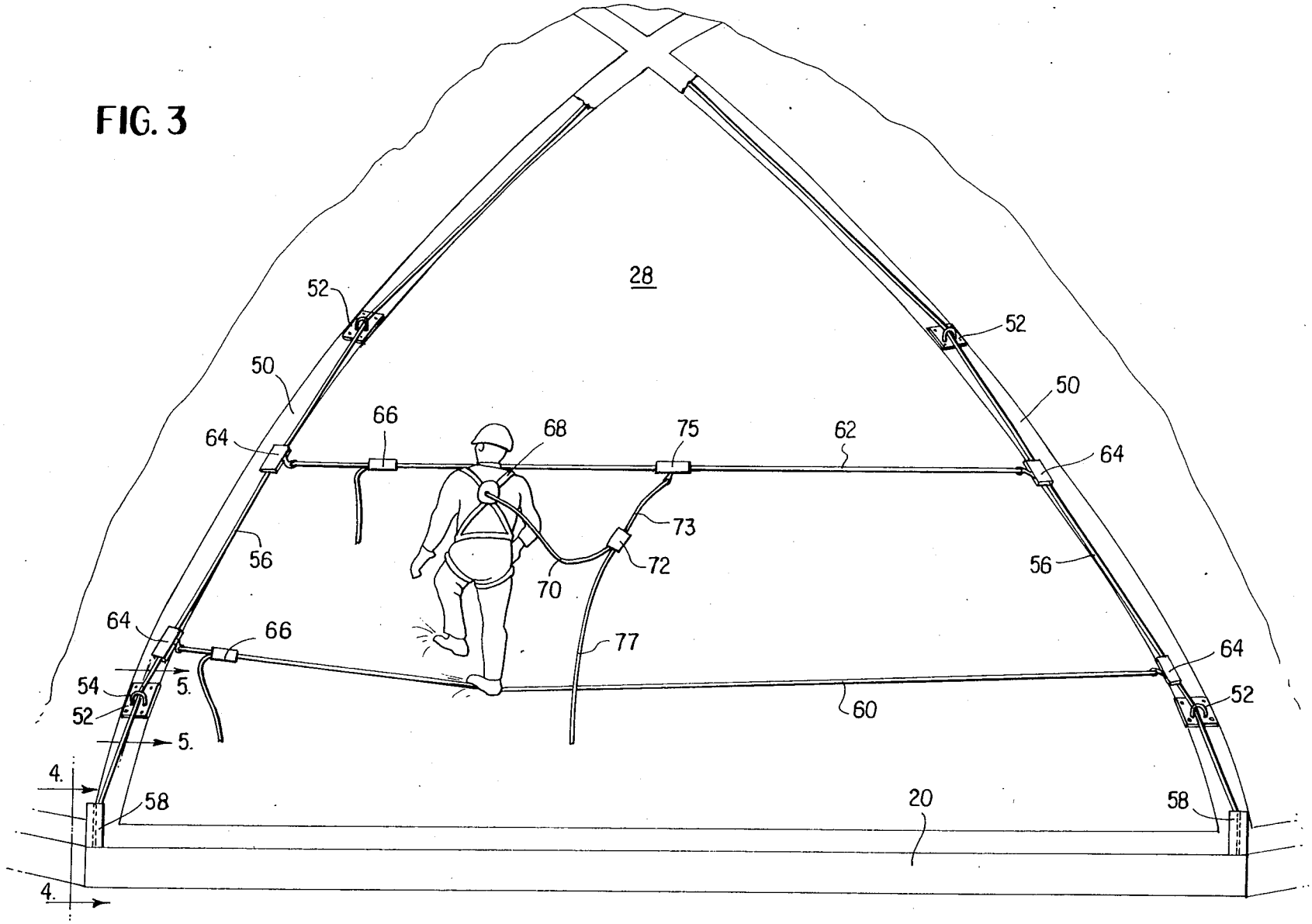
FIG. 3 is a fragmentary elevational view of a single panel of the inflatable roof structure, showing the safety rigging system of the installed thereon.
Figure 4:
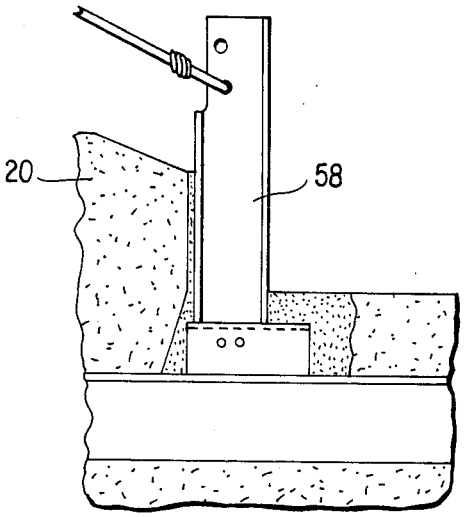
FIGS. 4 and 5 are fragmentary sectional views taken on the lines 4—4 and 5—5, respectively, of FIG. 3.

Referring now to FIG. 3, a single panel of the roof is shown equipped with the rigging system of the present invention. The panel 28 is located at the perimeter of the roof, but, as will be apparent hereinafter, the rigging system is also employed with those panels remote from the perimeter. The lateral edges 50 of the panel overly the corresponding ones of the support cables 24 and 26. At spaced intervals of, for example, forty feet along these lateral edges, eye pads 52 are provided, the pads being affixed to the supporting cables and suitably sealed to the roof membrane. Threaded through the eyes 54 of the eye pads 52 is a rope 56 which may, for example, be a $\frac{3}{4}$ inch nylon rope. The rope is anchored at its ends to anchor posts or brackets 58 which, as can be seen from FIG. 4, are securely attached to the structure of the compression ring 20. These anchor posts serve as the principal load carrying means for the ropes 56, the eye pads 52 serving primarily to maintain the position of the ropes within the roof valleys overlying the support cables. Preferrably, the ropes 56 are permanently attached. A rope is provided for each cable of the roof structure with the result that each panel of the roof is provided with a safety rope along each side thereof.

When workers are on the roof, one or more safety lines 60, 62, which may also be ¾ inch nylon rope, are run horizontally between adjacent ropes 56. Rope grabs 64 are employed to connect the safety lines to the ropes and to permit adjustment thereof. As the distance between adjacent ones of the ropes 56 varies along the height of each panel, a rope jam 66 is provided on each safety line 60, 62 to adjust the length thereof. Each worker wears a harness 68, such as a parachute type safety harness, which is connected by a lanyard 70 and rope grab 72 to an additional line 73 attached at one end to one of the safety lines 60, 62 by a rope grab 75, the grab 72 permitting the lanyard to be moved along the additional line 73 and the grab 75 permitting the point of attachment to be moved along the safety line as desired. In the event of a fall on the roof surface, the free end 77 of the additional line may be grasped to enable the worker to move upwardly on the slope of the roof.

Figure 5:
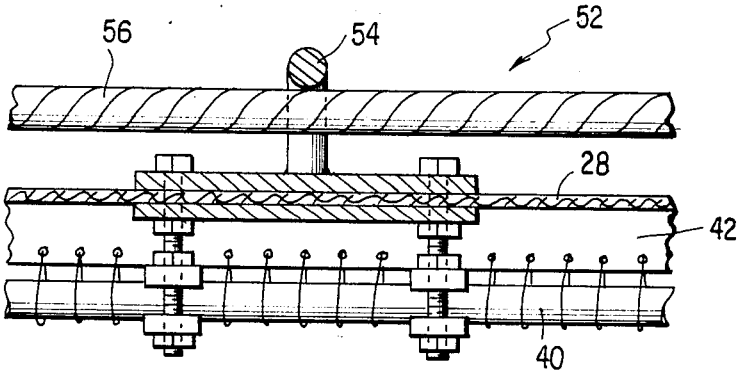

An arrangement which may be employed for affixing the eye pads 52 to the support cables is shown in FIG. 5 It will be understood, however, that other attaching arrangements may be employed. The eye pad 52 includes a base plate 74 provided with four bolt holes for receiving bolts 76, these bolts extending through the roof membrane to cable clamps 78 on the support cable 40. A clamping plate 80 may be provided on the interior surface of the membrane and, by use of suitable sealants, the base plate 74 and bolts 76 may be made weathertight relative to the membrane 28.

Figure 6:
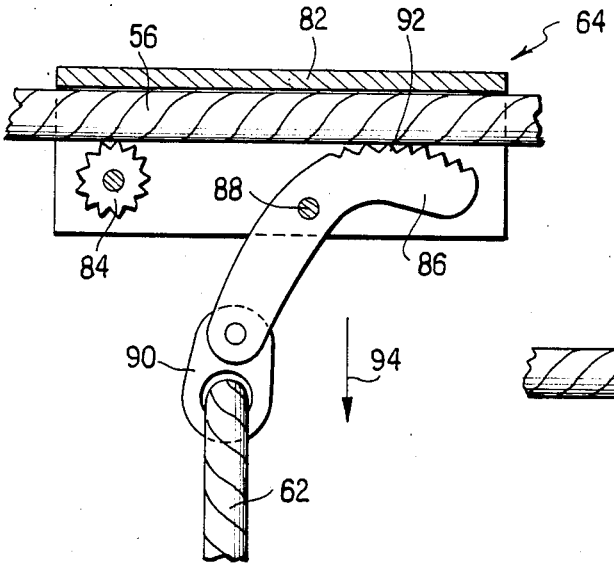
FIG. 6 is a schematic showing of a rope grab of the type which may be in the safety rigging system of the present invention.

The rope grabs 64, 72 and 75 are commercially available items obtainable, for example, from Swing Stages, Inc., South El Monte, Calif. 91733. The principal of operation of these devices is shown in FIG. 6. In a typical rope grab, the rope 56, for example, passes through the grab between a backing plate 82 and guide roller 84 and camming lever 86, the camming lever being pivotally mounted by a pin 88 and carrying an eye 90 for reception of the safety line 60, for example. The rope engaging face 92 of the camming lever is serrated and, when the eye of the camming lever is pulled in the direction of the arrow 94, the rope is tightly clamped between the backing plate 82 and the face 92 of the camming lever.

Figure 7:
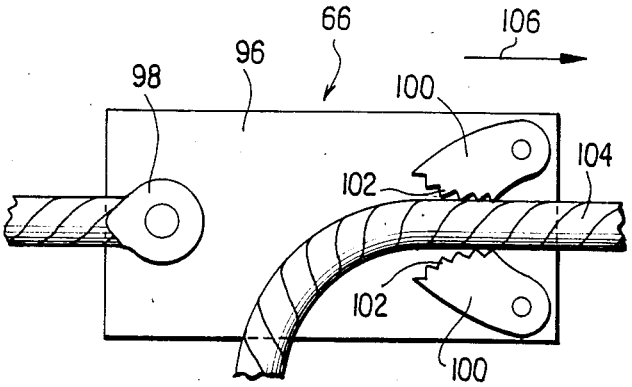
FIG. 7 is a schematic showing of a rope jam of the type which may be employed in the safety rigging system of the present invention.

The rope jams 66 are also commercially available, for example from W. M. Bashlin Company, Grove City, Pa. The principle of operation of the rope jam is shown in FIG. 7. The jam includes a body 96 to which the end 98 of one portion of safety line 60 is anchored. A pair of jaws 100 having serrated faces 102 are pivotall mounted on the body 96 and receive an end 104 of the other portion of the safety line 60 therebetween. The jaws are mounted so that a pull on the line 60 in the direction of the arrow 106 causes the jaws to pivot inwardly thereby tightly clamping the line.

It will be apparent that the rigging system of the present invention provides an effective protection arrangement for workers on an inflatable, fabric panel roof structure. When used with an existing roof, the only modifications of the structure necessary are the installation of the eye pads 52 and the mounting of the anchor posts 58 and, by use of suitable sealants, the watertight integrity of the roof is maintained. In other cases, the original watertight integrity of the roof need not be affected if eyelets are integrated into existing roof cable lightning arrestor foot pads. In the event a roof panel is ruptured, the workers are protected from falling by the safety line and harness arrangement while being able to move with a minimum of restraint while working on the roof.

While a preferred embodiment of the invention has been shown and described, it will be understood that changes and additions may be made therein and thereto. Accordingly, reference should be had to the appended claims in determining the true scope of the invention.

We claim:

1. A safety rigging system for use by workers moving on the exterior of an air-supported fabric roof structure comprising:
   - plurality of safety ropes extending across the exterior of said roof structure in spaced relation to one another:
   - means for anchoring the ends of each said safety rope at the perimeter of said roof structure;
   - means for securing each of said ropes to said roof structure at spaced intervals along said ropes;
   - at least one safety line extending between two of said safety ropes; and
   - means for attaching said safety line to said safety ropes.

2. The safety rigging system of claim 1 further including means for adjusting the length of said safety line.

3. The safety rigging system of claim 1 further including a safety harness adapted to be worn by a worker and means for connecting said safety harness to said safety line.

4. The safety rigging system of claim 3 wherein said means for connecting includes a lanyard attached at one end to said harness and attachment means for securing the other end of said lanyard to said safety line.

5. A safety rigging system for use by workers moving on the exterior of an air-supported roof structure of the type having first and second sets of intersecting cables extending across the structure and fabric panels connected to the cables and extending thereacross to form a roof membrane, said rigging system comprising:
   - a plurality of safety ropes extending across the exterior of said roof, one rope being provided for each cable and overlying the same;
   - means for anchoring the ends of each said safety rope at the perimeter of said roof structure;
   - means for securing said ropes at spaced intervals therealong to said cables:
   - at least one safety line extending between two adjacent ones of said safety ropes; and
   - means for attaching said safety lines to said safety ropes.

6. The safety rigging system of claim 5 wherein said means for attaching are controllably moveable on said safety ropes to vary the position of said safety line.

7. The safety rigging system of claim 6 further including means for adjusting the length of said safety line.

8. The safety rigging system of claim 7 further including a safety harness adapted to be worn by a worker and means for connecting said safety harness to said safety line.

9. The safety rigging system of claim 8 wherein said means for connecting includes a lanyard attached at one end to said harness and attachment means for securing the other end of said lanyard to said safety line.

10. The safety rigging system of claim 5 further including a safety harness adapted to be worn by a worker and means for connecting said safety harness to said safety line.

11. The safety rigging system of claim 10 wherein said means for connecting includes a lanyard attached at one end to said harness and attachment means for securing the other end of said lanyard to said safety line.

12. The safety rigging system of claim 5 wherein said means for connecting includes clamp means engaging said cable.

* * * * *